United States Patent [19]

Bartz et al.

[11] Patent Number: 4,699,342

[45] Date of Patent: Oct. 13, 1987

[54] STAND FOR DISPLAYING BEVERAGES

[76] Inventors: William R. Bartz, 736 Dalewood Ct., San Jose, Calif. 95120; Wanda C. Donati, 1523 Yellowstone Ave., Milpitas, Calif. 95035

[21] Appl. No.: 841,197

[22] Filed: Mar. 19, 1986

[51] Int. Cl.[4] ..... A47G 23/02

[52] U.S. Cl. ..... 248/150; 248/174; 222/183

[58] Field of Search ..... 222/183, 105; 248/174, 248/176, 150

[56] References Cited

U.S. PATENT DOCUMENTS

| | | | |
|---|---|---|---|
| 2,831,610 | 4/1958 | Dennie | 222/183 X |
| 2,905,560 | 9/1959 | Bender et al. | 222/105 X |
| 4,240,565 | 12/1980 | Croley | 222/183 X |

*Primary Examiner*—Andrew V. Kundrat
*Attorney, Agent, or Firm*—Joseph H. Smith

[57] ABSTRACT

A stand is used for holding a box of liquid, the liquid to be dispensed from a spigot located near the bottom of the box. The stand includes a base element having a lower portion configured for sitting on a substantially flat surface and having a top portion attached to the upper portion for holding the box at a height above the flat surface sufficient for dispensing the liquid from the spigot into a drinking glass sitting on the flat surface. Also included is a constraint element attached to the top portion to constrain lateral motion of the box when the box is placed on the top portion. In general, the constraint element includes a lip attached to the top portion and extends upward from the top portion. A number of embodiments are shown and described.

10 Claims, 10 Drawing Figures

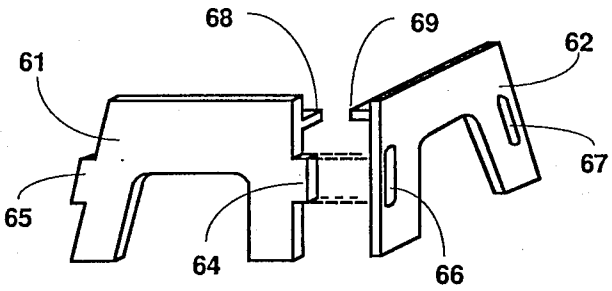
Fig. 6 (2 pairs)
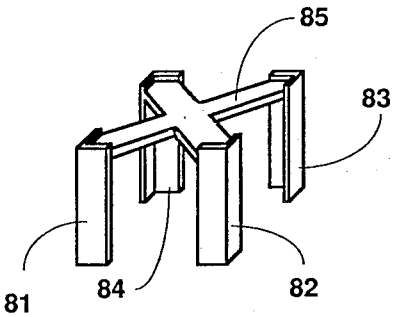
Fig. 8
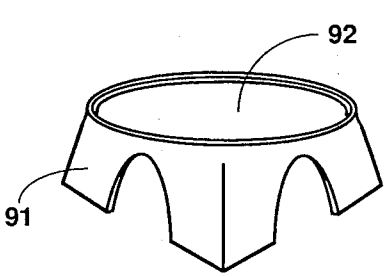
Fig. 9
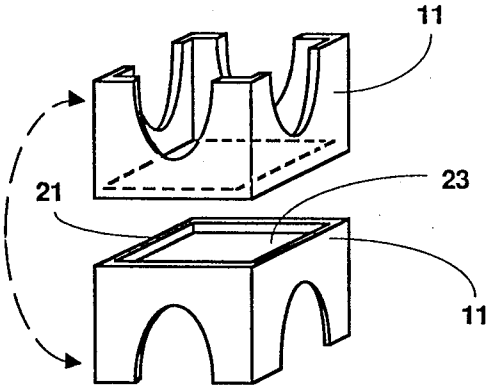
Fig. 1B
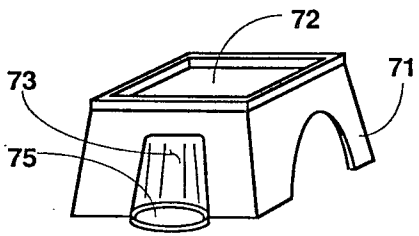
Fig. 7

STAND FOR DISPLAYING BEVERAGES

BACKGROUND OF THE INVENTION

This invention relates to stands for dispensing beverages, particularly wine and the like, which are contained in cartons having a spigot or other dispensing device attached thereto.

In the general art, numerous stands are well known. For example, as illustrated in U.S. Pat. No. 1,603,954, to Huston, there is a display stand where the item or container to be displayed rests in a horizontal seat with a depending lip, or front flange, which is used to overhang a counter in order to display advertising thereon. In that patent, an upper lip is used to constrain lateral motion of the container, but the horizontal seat is in very close proximity to the tabletop on which it rests. Similarly in U.S. Pat. No. 357,689 to Porrera, a glass dish or plate rests on a stand which has a lip for constraining lateral motion, but again, the stand does not significantly elevate the dish. The U.S. Pat. No. 1,537,598 to Goldman, a stand is used to elevate a decanter a considerable height above a horizontal surface, but the decanter therein is merely a tube which is lowered into the fluid which is to be decanted. The decanter is affixed to the stand to constrain motion of the decanter both horizontally and vertically, so that when the decanter is picked up, the stand is picked up with it. The height of the stand is chosen to avoid the decanting of sediment below the tube.

None of the devices however, are equipped to restrain lateral motion of present day containers which have a spigot thereon, and which merely rest on a stand at a convenient height for dispensing liquids directly into a beverage glass without having to move the stand or the container holding the beverage.

SUMMARY OF THE INVENTION

In accordance with preferred embodiments of the invention, a stand is used for holding a box of liquid, the liquid to be dispensed from a spigot located near the bottom of the box. The stand includes a base element having a lower portion configured for sitting on a substantially flat surface and having a top portion attached to the upper portion for holding the box at a height above the flat surface sufficient for dispensing the liquid from the spigot into a drinking glass sitting on the flat surface. Also included is a constraint element attached to the top portion to constrain lateral motion of the box when the box is placed on the top portion. In general, the constraint element includes a lip attached to the top portion and extends upward from the top portion.

Generally, the top portion is configured in a shape conforming substantially to the shape of the box, i.e. typically either rectangular or circular. Also, the stand may be constructed with three or more legs, or no legs at all.

Also in some embodiments, the stand has substantially vertical sides and has an interior which conforms substantially to the shape of the box of liquid it is to contain. In that embodiment, the stand can be inverted and the box can be placed therein for storage purposes.

In another embodiment, a top is constructed to fit over the top of the box and over the top of the lip to obscure the box and any advertizing material which may be printed thereon.

In another embodiment, the stand is made of four interlocking upright sides which can be bonded together to form a rectangular shape.

Another embodiment includes a glass locator attached to the bottom portion of the stand and a drip pan.

BRIEF DESCRIPTION OF THE DRAWINGS

FIGS. 1A and 1B show a first embodiment of the invention.

FIG. 6 shows a sixth embodiment of the invention which is made up of four snap-together pieces.

FIG. 7 shows a seventh embodiment of the invention which includes a glass locator and a drip pan.

FIG. 8 shows an eighth embodiment of the invention made up of four corner supports and a cross-member.

FIG. 9 shows a ninth embodiment of the invention which has a square lower portion and a circular upper portion.

DETAILED DESCRIPTION OF THE INVENTION

Figure 1A:
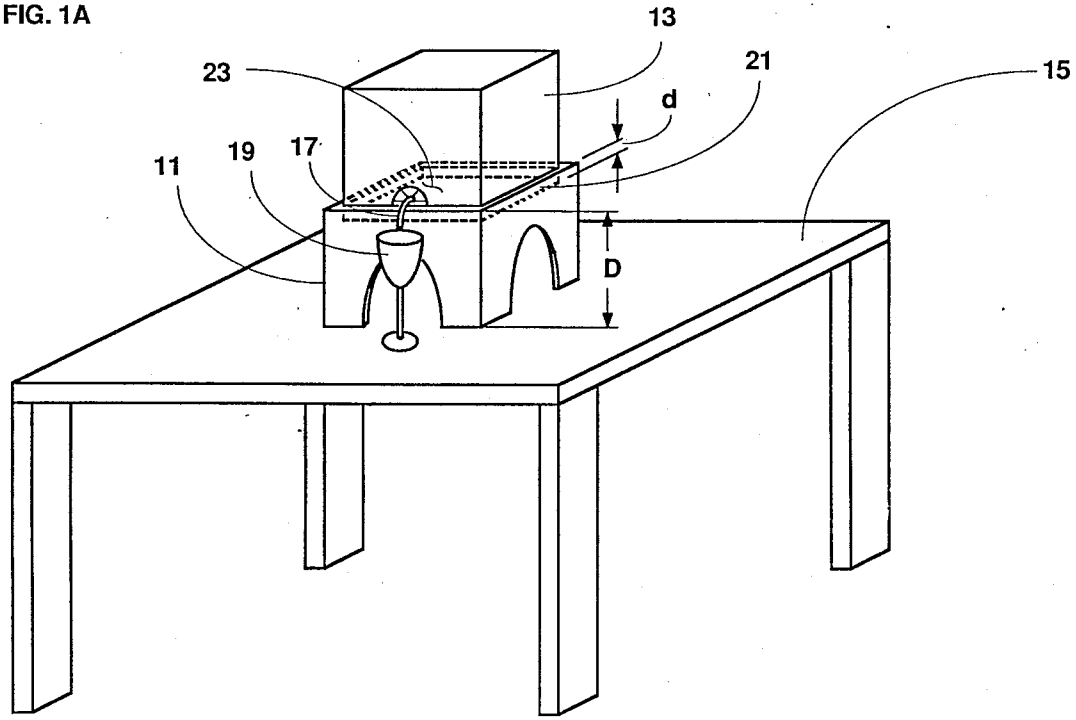

In accordance with preferred embodiments of the invention, shown in FIGS. 1A and 1B is a stand 11 for elevating a box 13, a convenient distance D above a tabletop 15. Box 13 is of a widely known type used for dispensing wine and the like and in the typical configuration, has the shape of a rectangular parallelopiped and has a collapsible plastic liner (not shown) inside the box for holding the beverage. Also included is a spigot 17 typically a plastic pinch-tube or a valve, which is attached to the liner which serves for dispensing the wine. Typically in the prior art, the spigot is located near the bottom of the liner, generally within one inch. When the spigot is opened, the wine runs out of the spigot, the liner collapsing as the liquid flows out. In the typical prior art situation, the box 13 is set on a tabletop with the spigot extending over the edge of the tabletop so that a glass can be held thereunder when it is to be filled, often making a mess on the floor when the spigot drips when a glass is not there, or if one removes the glass too quickly when filling it.

With the invention illustrated in FIGS. 1A and 1B, these problems are substantially eliminated. The stand 11 elevates the box of liquid to a convenient height above the tabletop for dispensing, the distance D typically having a range of 6 to 12 inches, and preferably about 7 inches, to accomodate a wine glass 19. In this manner, the height above the tabletop is not extreme so that if a drop falls from the spigot and does not hit the glass, it does not splatter extensively. This is unlike the prior art situation where a drop falls to the floor since often the floor is 30 inches or more away. In the embodiment illustrated in FIGS. 1A and 1B, stand 11 is typically constructed of plastic approximately one-quarter inch thick, although other thicknesses can also be used as long as the stand has sufficient strength to support the weight of the beverage it is to hold. Similarly other materials can be used, for example metal is a typical candidate. In the present situation where wine is in box 13, the typical dimensions for the top 23 of stand 11 are 6.25 in. by 6.25 in. Also, the stand includes an upwardly extending lip 21 having a upward dimension "d" above the top 23 of about 0.5 in. to hold the box 13 in place laterally, so that as the box empties and becomes lighter in weight, it is still constrained and is not easily moved about laterally. The top 23 is also not generally a snug fit to the box 13, but has some small amount of play, about ⅛ inch around the perimeter so that the box can be easily tipped up onto one edge to empty the final few drops of liquid.

FIG. 1B also illustrates a second use of the stand as a storage unit, simply by turning it upside down. In that configuration, it has precisely the shape of the box 13, so that the box can be stored therein before or after use. Also, the stand serves to protect the box from damage during storage.

Figure 2:
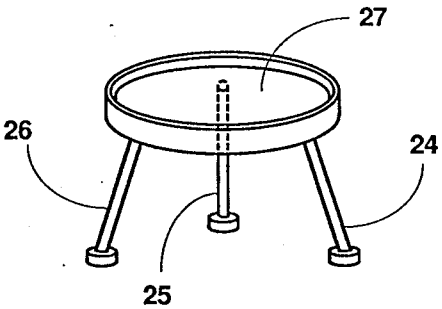
FIG. 2 shows a second embodiment of the invention which has only three legs.

FIG. 2 shows another embodiment of the invention which has only three legs 24, 25 and 26 and is convenient for use where a flat tabletop is not available, for example, such as when camping. In this embodiment, the stand has a round top 27 which can be used for square boxes having a diagonal equal to the diameter of the top, or for round boxes, (i.e. having the shape of a right circular cylinder).

Figure 3:
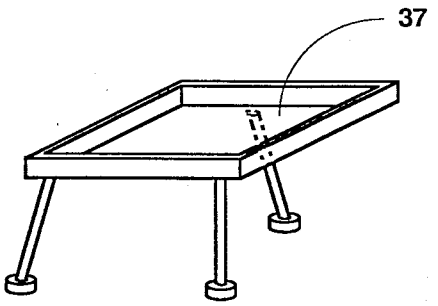
FIG. 3 shows a third embodiment of the invention which has only three legs.

FIG. 3 shows another embodiment of the invention, again having only three legs, but with a square top 37 for accomodating square boxes.

Figure 4:
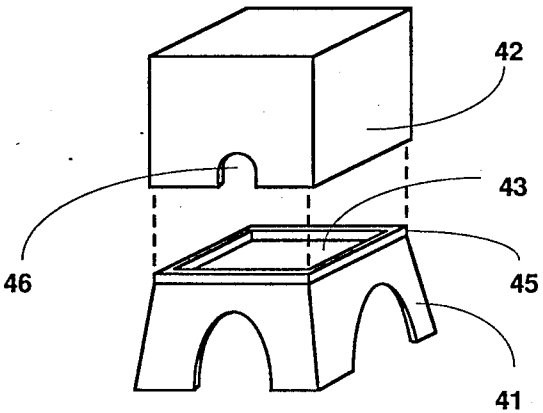
FIG. 4 shows a fourth embodiment of the invention which can be used to hide the box of liquid to be held by the stand.

FIG. 4 shows an embodiment of the invention which includes a top enclosure 42 which snugly fits over the top portion 43 and over the lip 45 of a base 41. In this embodiment, the top enclosure is designed to completely cover the box inside (not shown) so that advertising and the like on the box is obscured. The top enclosure 42 can be used as desired to carry logos, advertizing, or other aesthetics. A cut-out 46 is included in the top enclosure 42 to accomodate a spigot, the cut-out typically extending upward a distance of about 4 in. and having a width at the bottom of about 2.5 inches. In the embodiment shown, the sides of the base have approximately a 5° tilt, and the edges of the cut-out are tapered at 5° toward the top to run parallel to the edges of the base. For a base with vertical sides, it is preferred that the edges of the cut-out also be vertical for aesthetic reasons.

Figure 5:
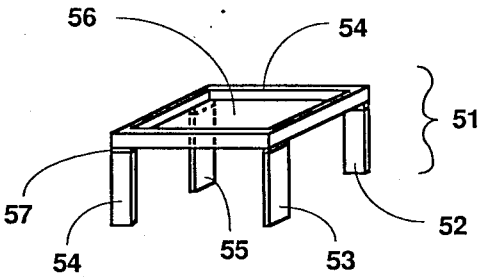
FIG. 5 shows a fifth embodiment of the invention which has fold-up legs.

FIG. 5 shows another embodiment of the invention whereby stand 51 has fold-up legs 52, 53, 54 and 55, attached by hinges such as hinge 57 to a substantially flat top 56. Stand 51 also has an upwardly extending lip 54 as in the previous embodiment. The folding legs permit the stand to be easily collapsed into a relatively small space for storage.

FIG. 6 shows a collapsible stand made up of four side pieces such as pairs of sides 61 and 62 which can be snapped together. Once snapped together, the side pieces can be bonded together if so desired for a permanent non-collapsible structure. Typically each side piece is beveled at 45° for meeting at the corners, and side 61 has flanges 64 and 65 to snap into openings such as 66 and 67 depending on how the apparatus is arranged. Also shown is a top flange 68 on side 61 and a top flange 69 on side 62 which are used to support the bottom of the box of wine by its edges. Flanges 68 and 69 extend out from the sides approximately 2 inches and are located about 1 inch below the top of the sides.

FIG. 7 shows yet another embodiment of the invention in which a stand 71 incorporates a closed area 73 having a cylindrically curved concave surface extending vertically downward from near top portion 72 (typically beginning within 1 to 2 inches of the top) to accomodate a beverage glass. The radius of curvature of closed area 73 can vary considerably depending on the type of glass to be used. However, a 2 inch radius appears to work well for a large range of glass sizes. This configuration is especially useful for those designs where the lower portion of the stand is flared outward as illustrated, making it difficult to get a glass close to the stand so that the glass will be difficult to get beneath the spigot. Also included is a drip pan 75, typically a flat circular element, which also helps to conveniently locate a beverage glass relative to the stand. In practice, the closed area 73 and the drip pan 75 can be incorporated into the stand itself, or as separate elements which can later be attached to the stand.

FIG. 8 shows another embodiment of the invention which is made up of four identical corner supports 81–84, and a cross member 85 which is set below the tops of the corner supports a small distance. Each of the corner supports incorporates a right angle to appropriately constrain lateral motion of the beverage box to be set thereon. Cross member 85 serves as the bottom support for the box.

FIG. 9 shows another embodiment of the invention which has a square bottom 91 which makes a smooth transition to a circular top 92, for use where four legs are desired for carrying the weight of a circular box.

We claim:

1. A stand for holding a box of liquid, the liquid to be dispensed from a spigot located near the bottom of said box, comprising:

base means having a lower portion configured for sitting on a substantially flat surface, and having a top portion attached to said lower portion said top portion defining a top portion area for holding said box at a height above said flat surface sufficient for dispensing said liquid from said spigot into a drinking glass sitting on said substantially flat surface, said lower portions of said base means being hollow and open, up to said top portion, and defining an area where said lower portion sits on said substantially flat surface which is larger than said top portion area, said bottom portion sloping smoothly in a non-vertical direction toward said top portion in the shape of a truncated rectangular pyramid; and constraint means attached to said top portion for constraining lateral motion of said box when said box is placed on said top portion.

2. A stand as in claim 1 wherein said constraint means comprises a lip attached to said top portion and extending in an upward direction relative to said top portion.

3. A stand as in claim 2 wherein said top portion has a shape conforming substantially with the shape of the box.

4. A stand as in claim 2 wherein said top portion has a rectangular shape.

5. A stand as in claim 2 wherein said top portion has a circular shape.

6. A stand as in claim 2 further comprising a cover which fits over said box when said box is sitting on said top portion.

7. A stand as in claim 2 further comprising a glass locator affixed to said lower portion.

8. A stand as in claim 1 wherein said lower portion has an internal shape conforming substantially to the shape of said box, so that when said stand is inverted the box will fit therein.

9. A stand for holding a box of liquid, the liquid to be dispensed from a spigot located near the bottom of said box, comprising:

base means having a lower portion configured for sitting on a substantially flat surface, and having a top portion attached to said lower portion for holding said box at a height above said flat surface sufficient for dispensing said liquid from said spigot into a drinking glass sitting on said substantially flat surface; and constraint means attached to said top portion for constraining lateral motion of said box when said box is placed on said top portion, said constraint means comprising a lip attached to said top portion and extending in an upward direction relative to said top portion;

said lower portion and said top portion together comprising two pairs of mating parts, each part of one pair having a flange and each part of the other pair having a hole which mates with said flange, said parts arranged in an interlocking manner forming a perimeter around said top portion which is a quadrilateral.

10. A stand for holding a box of liquid, the liquid to be dispensed from a spigot located near the bottom of said box, comprising:

base means having a lower portion configured for sitting on a substantially flat surface, and having a top portion attached to said lower portion for holding said box at a height above said flat surface sufficient for dispensing said liquid from said spigot into a drinking glass sitting on said substantially flat surface; and constraint means attached to said top for constraining lateral motion of said box when said box is placed on said top portion, said constraint means comprising a lip attached to said top portion and extending in an upward direction relative to said top portion;

a glass locator affixed to said lower portion; and a drip pan affixed to said glass locator.

* * * * *